United States Patent [19]

Mullen

[11] 4,210,242

[45] Jul. 1, 1980

[54] REPAIR KIT

[76] Inventor: James Mullen, 106 Edgewood Ave., Greenbrook, N.J. 08812

[21] Appl. No.: 40,681

[22] Filed: May 21, 1979

[51] Int. Cl.[2] ..... B25G 3/00; F16D 1/00; F16G 11/00

[52] U.S. Cl. ..... 206/231; 273/54 A; 403/300; 403/306

[58] Field of Search ..... 206/231, 223; 273/54 A, 273/54 R; 403/306, 305, 300

[56] References Cited

U.S. PATENT DOCUMENTS

| | | | |
|---|---|---|---|
| 577,220 | 2/1897 | Whitehead | 403/306 |
| 1,555,847 | 10/1925 | Hudson | 403/306 |
| 1,606,615 | 11/1926 | Dunham | 403/306 |
| 1,831,856 | 11/1931 | Fullman | 403/306 |
| 2,447,956 | 8/1948 | Morders | 403/306 |
| 3,257,112 | 6/1966 | Webb | 273/54 A |

*Primary Examiner*—William T. Dixson, Jr.

[57] ABSTRACT

In a repair kit for a broken rake arm in an automatic bowling pin setting machine, an elongated rigid sleeve is slipped over the rake arm such that the sleeve straddles the break. A fastener is threaded through the wall of the sleeve and grippingly bears against the outside surface of the rake arm. The sleeve is provided with a rigid strap that extends past the end of the sleeve in order to permit the accomodation of one end of a spring thereto. In one embodiment a right and left hand kit is required for the right and left hand rake arms of the bowling pin setting machine. Two other embodiments provide repair kits that are selectively useable as either a right hand kit or a left hand kit.

11 Claims, 9 Drawing Figures

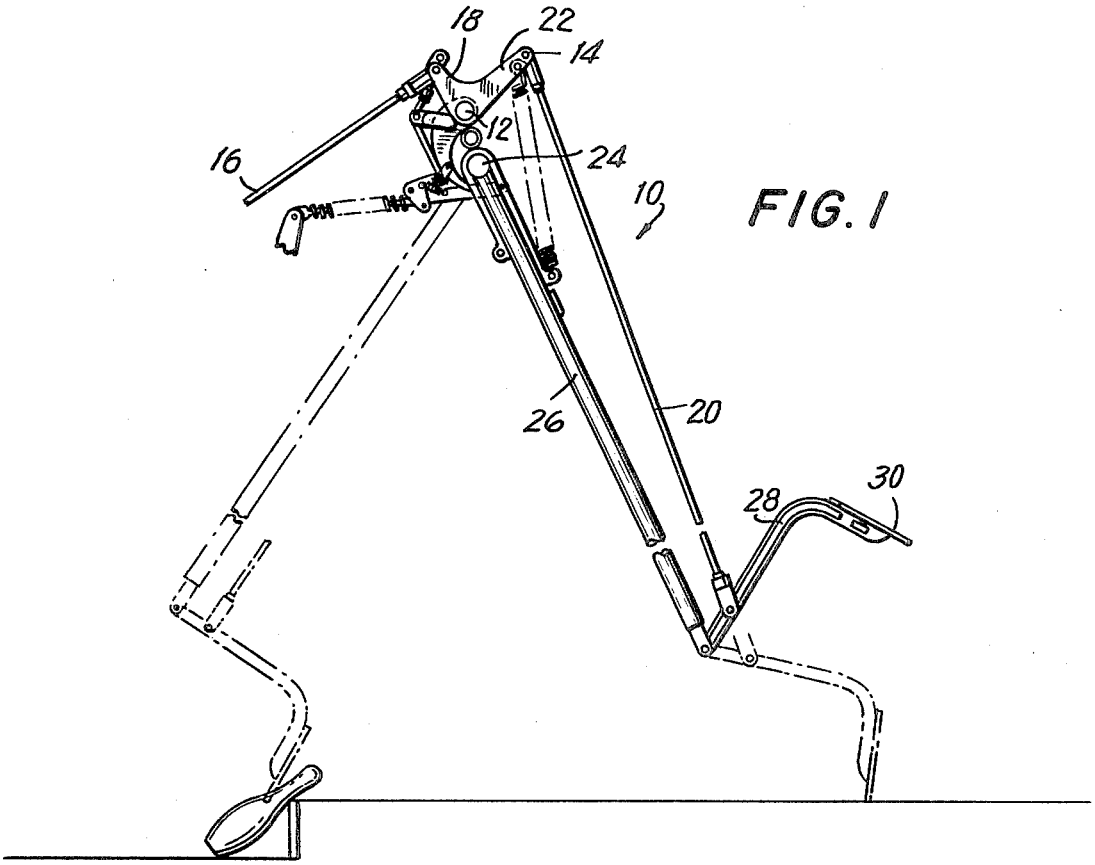
FIG. 1
FIG. 2
PRIOR ART
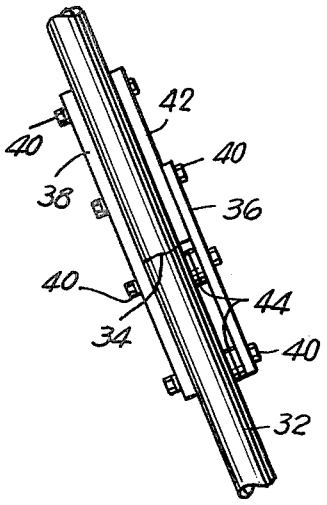
FIG. 3
PRIOR ART
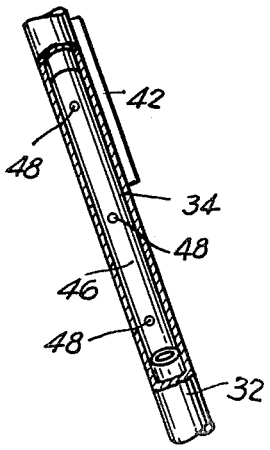
FIG. 4
PRIOR ART
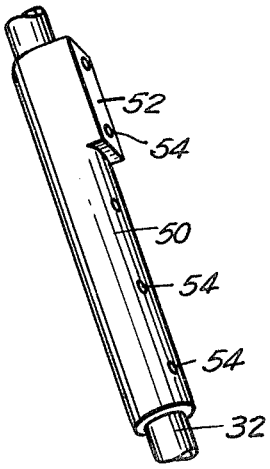

72
71
M
B
N
70
68
66
72
5a
71
5a
66

92
88
90
84
90
86
d
d
90
64
62
78
76
82
80
60

74
76
78
64

REPAIR KIT

BACKGROUND OF THE INVENTION

1. Field of the Invention

This invention relates generally to automatic bowling pin setting machines and more particularly to a repair kit for a broken rake arm in an automatic bowling pin setting machine.

2. Description of the Prior Art

Automatic pin setting machines are of almost universal use in bowling alleys today. Automatic pin setting machines, to be sanctioned by the American Bowling Congress must, among other things, be reliable and durable.

In addition to many other complex mechanisms, the automatic pin setting machines currently in use today include a rake assembly that sweeps the dead wood from the lane into the pit and also protects the deck when it is down in the event a ball is thrown at an improper time. In part, the rake assembly comprises two laterally spaced apart rake support arms that are fixed to the rake sweep shaft which is pivoted on top of the pin setter frame. At the bottom of the rake support arms, two pivotally mounted rake sweep arms are secured, to which are mounted a transverse rake board. When the rake board is drawn rearwardly by the rake support arms, dead wood is swept from the pin area. The rake board lowers to the lane immediately after delivery of a ball and remains down during the entire pin setter cycle thereby protecting the deck.

It will be evident from the foregoing that the rake arm assemblies are normally subjected to considerable use and are likely to be abused when their environment is taken into consideration. It has been found that the rake support arms, which are generally elongated steel tubes, are highly susceptible to damage in the form of cracks. In order to minimize down time and to reduce the cost of repairs it has become a common practice to reinforce a broken rake arm rather than to replace it.

There are several different types of repair kits presently available for repairing a broken rake arm. One form of repair kit provides splint-like straps that straddle the brake in the rake arm and are bolted thereto. This requires drilling through the broken rake arm which is not only time consuming but also requires considerable skill since the pairs of holes that go through the opposing wall surfaces must be coaxially aligned and must also have precisely the same centers as the holes in the splint-straps.

Another form of prior art repair kit provides a rod or tube that is fitted internally of the broken rake arm. The rod or tube straddles the brake in the rake arm and extends above and below it. Suitable fasteners such as bolts extend through the wall surfaces of the rake arm as well as through the rod or tube in order to retain it in place. It will be evident that considerable on-site skill is required with this second form of repair kit during the drilling operation prior to the placement of the bolts.

Yet another form of prior art repair kit provides a sleeve that fits externally over the rake arm and also straddles the break therein. Suitable set screws are used to secure the sleeve to the rake arm in order to eliminate the need for drilling bolt holes. The drawback of this form of kit resides in lack of adaptability to different types of rake shaft assemblies, such as for example the presently employed assemblies manufactured by Brunswick Corporation.

SUMMARY OF THE INVENTION

The present invention provides for an elongated sleeve to be placed in a straddling position over the break or break in the rake arm. A fastener is threaded through the wall of the sleeve and grippingly bears against the outside surface of the rake arm. A rigid strap is suitably secured, such as by welding, to the sleeve such that the strap is in a plane that is parallel to and is laterally offset from the central axis of the sleeve. The spring that couples the V-levers to the rake arm is attached to the strap.

In one embodiment of the present invention the strap is welded in place such that right and left hand repair kits are required for the right and left hand rake arm assemblies, respectively. In a first alternative embodiment a bar is rigidly secured to the sleeve, such as by welding and the like, along the longitudinal axis thereof. It will be appreciated that both side faces of the bar are laterally offset from the central axis of the sleeve so that when a strap is removably secured to either of the side surfaces of the bar, such as by means of bolts or the like, the strap will be appropriately offset in a lateral direction. In this manner a single repair kit can be used for either the right hand or the left hand rake arm assembly merely by securing the strap to one or the other side surfaces of the centrally located bar.

In still another alternative embodiment of the present invention there is provided a single repair kit to be used on either the right or the left rake arm. A longitudinally centered sleeve is provided with a strap extending beyond each end of the sleeve. The strap is permanently secured to the sleeve in such a manner that the opposed ends of the strap extend beyond the ends of the sleeve. The strap is laterally offset from the central access of the sleeve so that by rotating the sleeve and the strap coupled thereto 180°, the repair kit can be used for either of the two rake arms.

It is therefore an object of the present invention to provide an improved repair kit for a broken rake arm in an automatic bowling pin setting machine.

It is another object of the present invention to provide an improved repair kit, as described above, that is usable on either the right hand or the left hand rake arm.

These and other objects, features and advantages of the invention will, in part, be pointed out with particularity, and will, in part, becme obvious from the following more detailed description of the invention, taken in conjunction with the accompanying drawings which form an integral part thereof.

BRIEF DESCRIPTION OF THE DRAWING

In the various figures of the drawing like reference characters designate like parts. In the drawing:

FIG. 1 is a side elevational view schematically and fragmentarily illustrating a typical rake assembly;

FIG. 2 is a perspective view illustrating one form of prior art rake arm repair kit;

FIG. 3 is a perspective view illustrating another form of prior art rake arm repair kit;

FIG. 4 is a perspective view illustrating still another form of prior art rake arm repair kit;

DESCRIPTION OF THE PREFERRED EMBODIMENTS

Figures 5, 5A, 6:
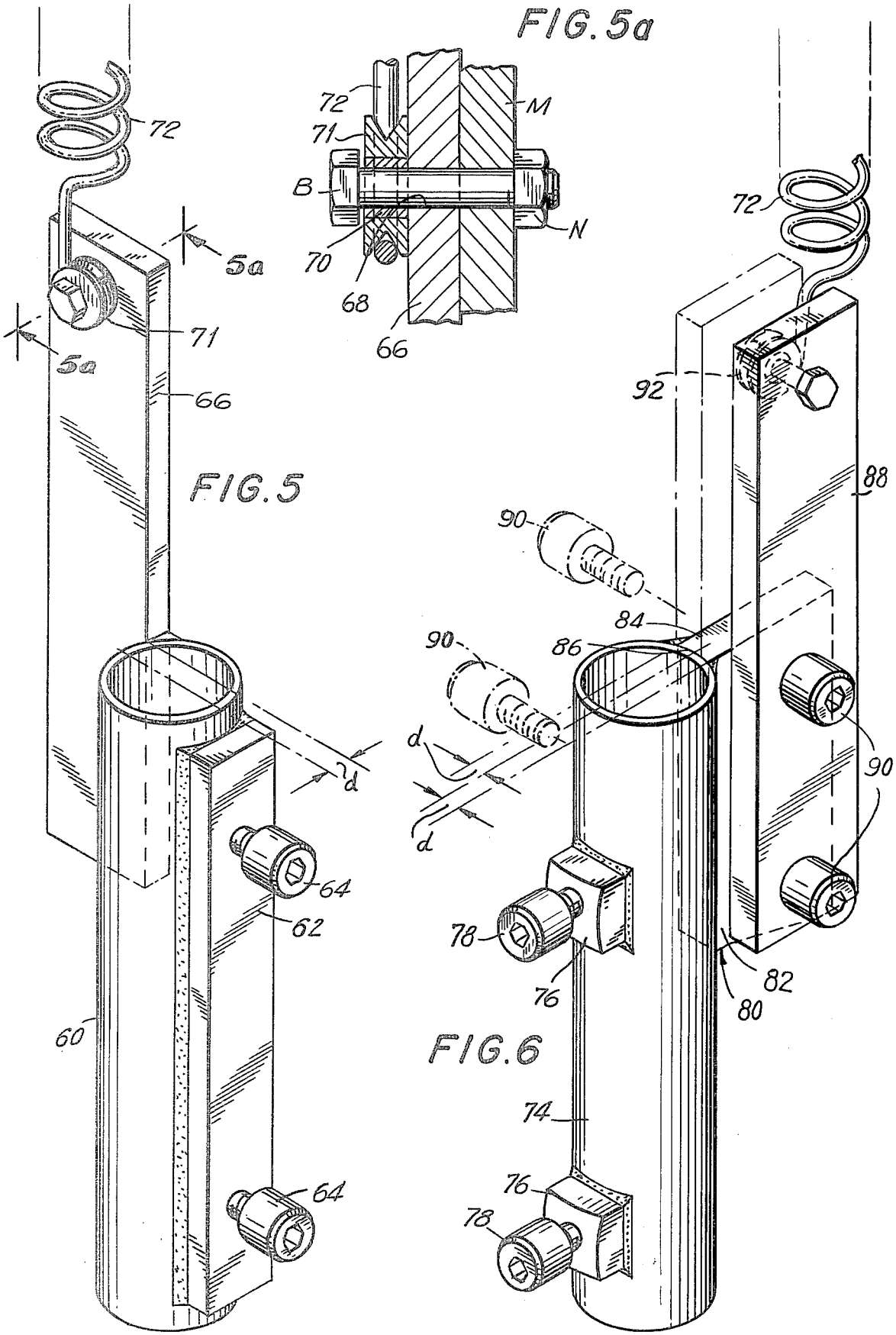
FIG. 5 is a perspective view illustrating one embodiment of the rake arm repair kit comprising the present invention.
FIG. 5*a* is a fragmentary sectional view taken along line 5*a*—5*a* of FIG. 5.
FIG. 6 is a perspective view of a second embodiment of the rake arm repair kit comprising the present invention.

The environment of the present invention can best be appreciated by a reference to FIG. 1 wherein there is fragmentarily shown a rake sweep assembly 10 that includes a transversely oriented rake lift shaft 12, the opposite ends of which support a pair of V-levers 14. A pit cushion lift rod 16 is suitably secured at one end thereof to one of the two arms 18 that constitutes the V-levers 14. One end of a rake lift rod 20 is suitably secured to the second arm 22 of the V-levers 14. A transversely oriented rake sweep shaft 24 is also provided for supporting the upper end of the rake support arms 26L and 26R. The lower end of the rake support arms 26L and 26R as well as the lower end of the rake lift rods 20 are pivotably connected to a rake sweep arm 28 on which is mounted a rake board 30. The foregoing structure is typical of the rake sweep mechanism employed in an automatic bowling pin setting machine.

Examples of prior art repair kits may be seen by reference to FIGS. 2, 3 and 4. In the FIG. 2 form of prior art it will be seen that the rake arm 32 is cracked, such as is designated by the reference character 34. In order to avoid the necessity of replacing the entire rake arm 32, a repair kit comprising straps 36 and 38 is provided. These straps 36 and 38 are fastened to the rake arm 32 as well as to each other by means of bolts 40. Since a portion of the rake arm 32 which is designated by reference character 42 is somewhat thicker, spacers 44 must be provided in order to avoid distorting the strap 36.

Another form of prior art repair kit is shown in FIG. 3. Once again the rake arm 32 is cracked such as shown by the reference character 34. In order to avoid replacement of the entire rake arm, a tube 46 is positioned therein and is secured in place by suitable fasteners, such as bolts 48. Since the tube 46 is internal of the rake arm 32, provisions need not be made for accomodating the enlargement 42 of the rake arm 32.

Still another form of prior art repair kit is shown in FIG. 4. The break in the rake arm 32 is not visible since an external sleeve 50 is utilized. It will be appreciated that the break would be someplace intermediate at the ends of the sleeve 50. In order to accomodate the enlargement 42, an enlargement 52 is provided on the sleeve 50. Suitable fasteners such as bolts 54 are utilized for securing the sleeve 50 to the rake arm 32.

While each of the prior art repair kits did provide a useful function it will be appreciated that certain drawbacks were involved. Perhaps the most readily apparent drawback is the need in each of the first two instances for drilling through the rake arm. Since the rake arm is normally made of a relatively hard material the drilling operation, which is usually carried out on-site, is difficult and time consuming and also requires considerable skill since the holes must be perfectly aligned in order to accomodate the fasteners. The third prior art repair kit, shown at FIG. 4, remedies the need for drilling holes in situ in the rake arm, but has the even more serious drawback of being totally inapplicable to the present types of rake arm assemblies. The present invention, of which several embodiments will now be discussed, overcome the shortcomings of the prior art in a most economical and facile manner.

Referring now to FIGS. 5 and 5*a* there is shown one embodiment of the present invention which comprises an elongated, rigid sleeve 60, preferably made of an appropriate metal having a suitable hardness. In the first embodiment of the present invention, the wall thickness of the sleeve 60 is locally increased by welding a bar 62 thereto. The increased thickness will thereby accomodate a sufficient number of threads of the fasteners 64 that are used for rigidly securing the sleeve 60 to the rake arm 32. Although a minimum of one fastener 64 may be used it is preferred that two or more axially spaced apart fasteners 64 be employed for improved holding power. Also welded to the sleeve 60 is a rigid strap 66 that abuts a permanent portion M of the bowling pin setting machine. The strap 66 has a side surface which is located in a plane that is parallel to and laterally offset from the central axis of the sleeve 60 by a dimension "d". One end of the strap 66 is provided with a hole 68 abutting which is placed a hollow spacer 70 for the purpose of accomodating a spring wheel 71 about which is hooked one end of a spring 72. Through the hole 68 and the hollow spacer 70 and a conventional fastener such as bolt B and a nut N is passed to securely position the spring wheel 71 and the upper end of the strap 66. The opposite end of the spring 72 is anchored in any suitable manner to the second arm 22 of the V-levers 14 as shown in FIG. 1.

Because the strap 66 is permanently secured to the sleeve 60 this first embodiment of the present invention requires right hand and left hand repair kits. If it is assumed that a left hand repair kit is illustrated in FIG. 5 then the right hand repair kit will have the strap 66 laterally offset in the opposite direction by the same dimension "d" with respect to the central axis of the sleeve 60. The remaining construction will be identical.

The embodiment illustrated in FIG. 6 eliminates the need for right and left hand repair kits. As in the previously described embodiment, a rigid, axially elongated sleeve 74 is provided and on which is suitably secured, such as by welding or the like, a pair of internally threaded pads or nuts 76 that are axially spaced apart. Bolts 78 extend through the nuts 76 as well as through co-axially located holes (not illustrated) that extend through the wall of the sleeve 74 to thereby permit the bolts 78 to grippingly bear against the outer surface of the rake arm 32. A rectangular bar 80 is welded or otherwise suitably secured to the sleeve 74 with the central plane of the bar 80 being coincidental with the longitudinal axis of the sleeve 74. It will be evident therefore that the two parallel surfaces 82 and 84 which are in planes perpendicular to the mounting edge 86 of the bar 80 are both laterally offset by the same dimension "d", one to the left and one to the right of the central axis of the sleeve 74. A rigid strap 88 is removably and replaceably secured to the bar 80 by means of fasteners such as bolts 90. As in the previous embodiment, a spring wheel 90 and a hollow spacer similar to spacer 70 is also provided for the purpose of supporting one end of the spring 72.

Assuming that a left-hand rake arm repair kit is illustrated in FIG. 6, it will be evident that a right hand rake arm repair kit can be assembled from the same components merely by changing the strap 88 from its mounting on surface 82 to a mounting on surface 84. This construction therefore eliminates the need for separate and different right hand and left hand rake arm repair kits. Obviously then the number of different parts that must be stocked and inventoried is reduced with an attendant savings in cost.

Figure 7:
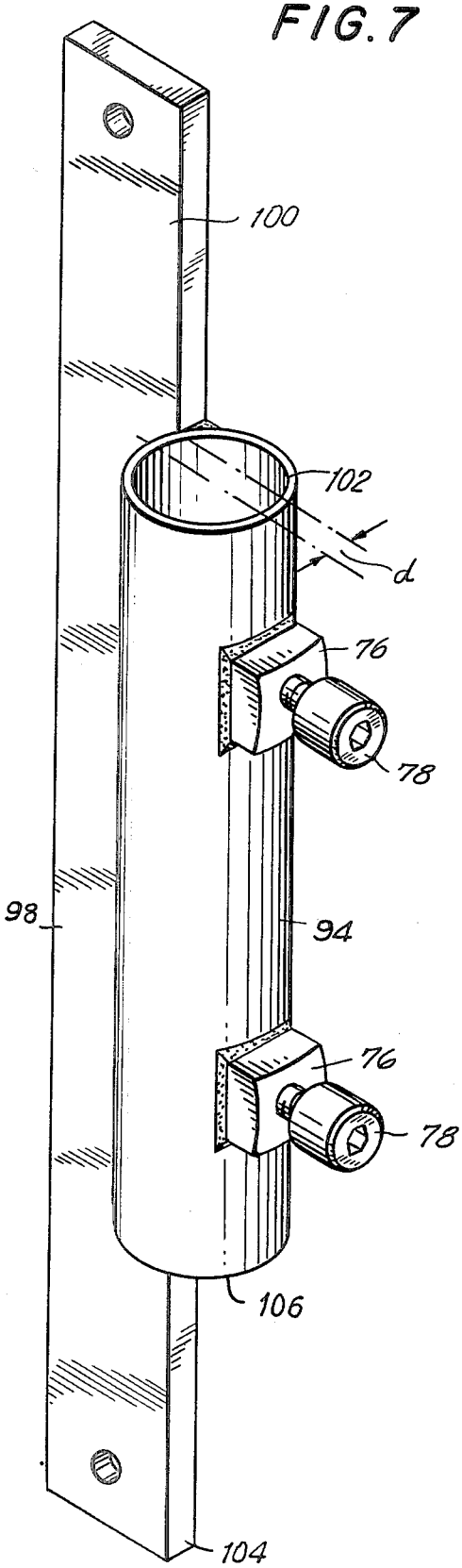
FIG. 7 is a perspective view of a third embodiment of the rake arm repair kit comprising the present invention.
Figure 8:
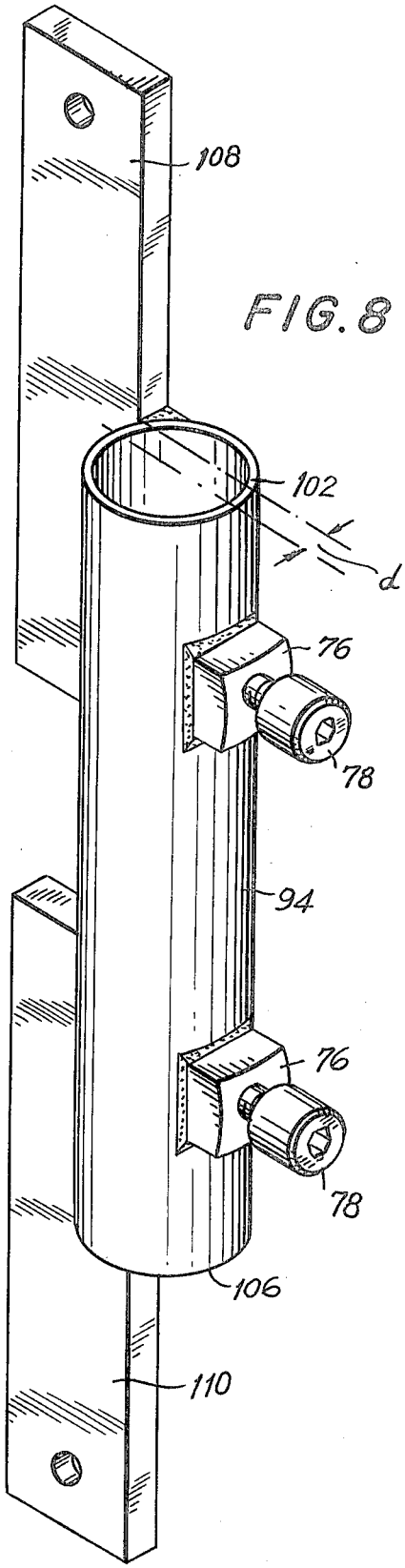
FIG. 8 is a perspective view of a modification of the third embodiment shown in FIG. 7.

Turning now to FIG. 7 there is illustrated still another embodiment that eliminates the need for right and left hand rake arm repair kits. In this last embodiment sleeve 94 provided with the hereabove mentioned fasteners 76–78 illustrated in FIG. 6 is coupled to a single strap 98 which extends beyond each end of the sleeve 94 as illustrated in FIG. 7. Alternatively the extending terminals 100, 104 of the strap 98 may constitute two separate straps 108 and 110 as shown in FIG. 8 rather than one single piece. For the same purpose described hereinabove in connection with the previously discussed embodiments, one end 100 of the strap 98 extends beyond the end 102 of the sleeve 94. Similarly, the other end 104 extends beyond the end 106 of the sleeve 94. The strap 98 is rigidly secured to the sleeve 94 by any suitable means such as welding or the like and is laterally offset in the same manner as described in connection with the FIG. 5 embodiment. With the FIG. 7 embodiment the same structure may be utilized with either the left hand rake arm or the right hand rake arm merely by rotating the repair kit assembly 180° in a plane that is parallel to the plane of the strap 98. Both extending ends 100 and 104 are provided with suitable means, for example a hollow spacer 70 such as described in connection with the FIG. 5 embodiment or a spacer 92 such as described in connection with the FIG. 6 embodiment for the purpose of serving the same function as previously discussed. Assuming that a left hand repair kit is illustrated in FIG. 7, then the strap end 100 would be utilized for accomodating the spring 72 and the strap end 104 would not be utilized. Alternatively, if the same assembly is to be used on the right hand rake arm then it will be rotated 180° from the position illustrated in FIG. 7 so that the strap end 104 is utilized and the strap end 100 is not. The same rotation of the FIG. 8 modification will result in the utilization of the strap end 110 instead of the strap end 108.

It will be appreciated from the foregoing that an improved repair kit for a broken rake arm in the presently most commonly used type of automatic bowling pin setting machine has been provided. One of the three embodiments described hereinabove requires left hand and right hand repair kits. Two of the three embodiments described hereinabove are universal to the extent that each one can be used on either a right hand or a left hand rake arm. Various means for securing the repair kit to the rake arm have been disclosed as well as various means for accomodating the spring.

There have been disclosed heretofore the best embodiments of the invention presently contemplated. However, it is to be understood that various changes and modifications can be made thereto without departing from the spirit of the invention.

What I claim as new and desire to secure by United States Letters Patent is:

1. A repair kit for a broken rake arm in an automatic bowling pin setting machine, said repair kit comprising:

a. elongated rigid sleeve means having an internal dimension slightly larger than the comparable external dimension of the rake arm to thereby permit said sleeve means to be slidably positioned over the broken portion of the rake arm;

b. at least one fastener threaded through the wall of said sleeve means and arranged to grippingly bear against the outside surface of the rake arm; and c. rigid strap means secured to said sleeve means in a plane that is parallel to and laterally offset from the central axis of said sleeve means with one end of said strap means extending past at least one of the ends of said sleeve means, said strap means being provided with a hole at at least one end thereof.

2. The repair kit according to claim 1 wherein said sleeve means is circular in transverse cross-section and said fastener is threaded radially through the wall thereof.

3. The repair kit according to claim 1 wherein said sleeve means has a thickened wall portion and said fastener is threaded therethrough.

4. The repair kit according to claim 3 wherein the wall of said sleeve means has a hole therethrough and said thickened wall portion comprises a nut secured to said sleeve means coaxially with said hole.

5. The repair kit according to claim 1 wherein said sleeve means is rigidly coupled to a strap means having a first end thereof extending past one end of said sleeve means and a second end thereof extending past the oppositely facing end of said sleeve means whereby said repair kit may be used with either the right side or the left side rake arm.

6. The repair kit according to claim 5 wherein said first and second ends extending past said ends of said sleeve means form two distinct and spaced straps.

7. The repair kit according to claim 1 wherein there are at least two axially spaced apart fasteners.

8. The repair kit according to claim 1 wherein said strap means is non-removably secured to said sleeve means.

9. The repair kit according to claim 1 wherein a rectangular bar is rigidly attached to and along the longitudinal axis of said sleeve means and wherein said strap means is removably secured to either one of the two parallel surfaces of said bar that are perpendicular to the attaching surface thereof whereby said repair kit may be used with either the right side or the left side rake arm.

10. The repair kit according to claim 1 further comprising hollow spacer means for accomodating spring wheel strap means.

11. The repair kit according to claim 10 where means in said spacer abutting against said strap in juxtaposition with the hole of said strap means.

* * * * *